United States Patent [19]

Rane

[11] Patent Number: 4,678,092

[45] Date of Patent: Jul. 7, 1987

[54] DISPOSABLE BABY BOTTLE

[76] Inventor: Melody A. Rane, 501 Ryan Ct., Eureka, Calif. 95501

[21] Appl. No.: 874,900

[22] Filed: Jun. 20, 1986

Related U.S. Application Data

[63] Continuation of Ser. No. 677,291, Dec. 3, 1984, abandoned.

[51] Int. Cl.[4] ..... A61J 9/00

[52] U.S. Cl. ..... 215/11 E; 215/11 R; 426/117

[58] Field of Search ..... 215/11 R, 11 C, 11 E; 383/104; 426/117

[56] References Cited

U.S. PATENT DOCUMENTS

| | | | |
|---|---|---|---|
| 2,110,928 | 3/1938 | De Buys | 215/11 E |
| 2,133,411 | 10/1938 | Zohe | 215/11 R |
| 2,446,451 | 8/1948 | Allen | 215/11 R |
| 2,497,198 | 2/1950 | Allen | 215/11 R |
| 2,524,021 | 9/1950 | Rigby et al. | 215/11 E |
| 2,599,630 | 6/1952 | Hair | 215/11 E |
| 2,624,485 | 1/1953 | Boston | 215/11 E |
| 2,718,105 | 9/1955 | Ferguson et al. | 383/104 X |
| 2,876,113 | 3/1959 | Barton | 215/11 E X |
| 2,987,209 | 6/1961 | Leonard | 215/11 E |
| 3,097,757 | 7/1963 | Searer | 215/11 R |
| 3,194,424 | 7/1965 | Barr | 215/11 R |
| 3,232,467 | 2/1966 | Barton | 15/11 E |
| 3,235,113 | 2/1966 | Seibert | 215/11 R |
| 3,477,603 | 11/1969 | Koll | 215/11 R |
| 3,523,026 | 8/1970 | Emerson et al. | 215/11 E |
| 3,746,198 | 7/1973 | Howland | 215/11 R |
| 3,800,843 | 4/1974 | Edwards | 215/11 E X |
| 3,804,952 | 4/1974 | McDonald | 215/11 R X |
| 4,193,506 | 3/1980 | Trindle et al. | 215/11 C |

FOREIGN PATENT DOCUMENTS

| | | | |
|---|---|---|---|
| 2417440 | 10/1979 | France | 383/104 |
| 1239600 | 7/1971 | United Kingdom | 215/11 E |

*Primary Examiner*—William Price
*Assistant Examiner*—Sue A. Weaver
*Attorney, Agent, or Firm*—Townsend and Townsend

[57] ABSTRACT

A disposable pre-filled baby bottle (10) includes a substantially cylindrical pouch (12) terminating in an open end. A substantially rigid annular ring (16) is positioned on the interior surface of pouch (12) at the upper portion thereof and molded thereto. Spiral threads (20) are disposed circumferentially about a portion of annular ring (16) and cooperate with threads located on a ring and nipple assembly (18) to attach the assembly onto disposable bottle (10). Annular ring (16) also includes a gripping collar (22) located below adjacent spiral threads (20). Collar (22) provides a gripping surface and thus facilitates the handling of bottle (10) as ring ad nipple assembly (18) is removed and replaced.

1 Claim, 4 Drawing Figures

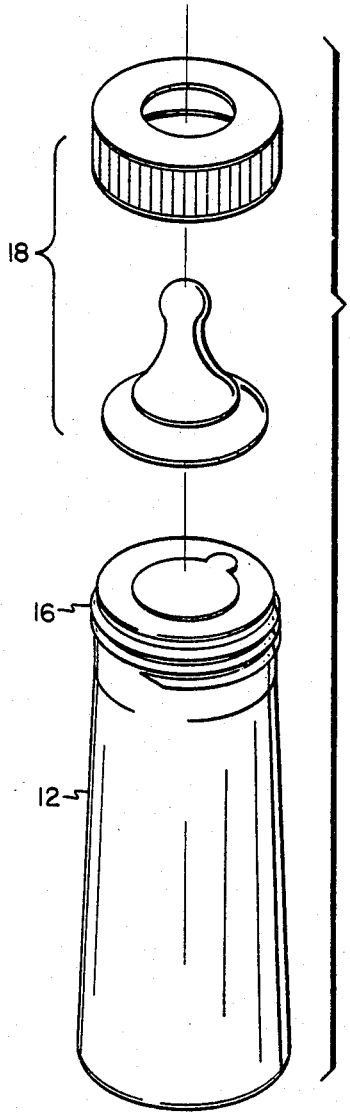
FIG. 1
FIG. 3
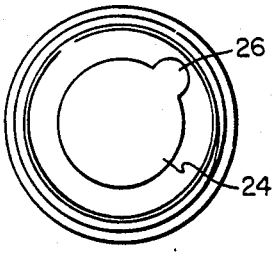
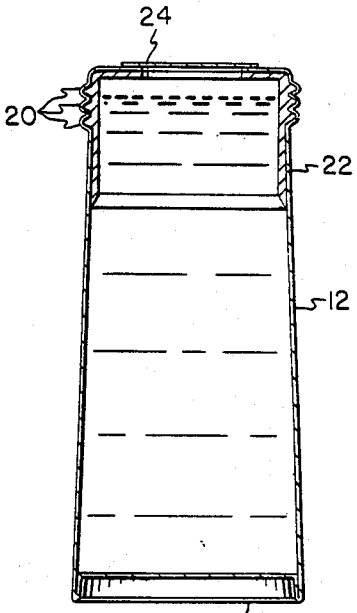
FIG. 2
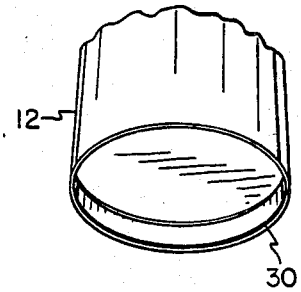
FIG. 4

DISPOSABLE BABY BOTTLE

This is a continuation of application Ser. No. 677,291, filed Dec. 3, 1984, now abandoned.

TECHNICAL FIELD OF THE INVENTION

This invention relates generally to feeding bottles for infants and small children and more specifically to a disposable feeding bottle that contains fully diluted ready to drink formula or liquid.

BACKGROUND OF THE INVENTION

In recent years, the marketing of fully prepared infant formula, juice or other liquid food substances in ready-to-use disposable bottles has gained increased popularity, as has the marketing of other similar disposable containers for receiving separately purchased liquids. Those disposable containers have provided enhanced convenience over the previous hard plastic or glass reuseable bottles. Those previous bottles were designed to be washed and sterilized after each use and thereafter refilled with separately purchased liquid for reuse. The disposable bottle disposes with the time associated with washing and sterilizing bottles and, in the case of the ready-to-use container as proposed in my invention, also relieves the consumer of having to separately purchase milk or formula.

Various types of disposable bottles have been developed. One disposable bottle consists of a hard plastic hollow tube designed to receive a disposable plastic bag or liner which is filled with separately purchased feeding liquid. A rubber nipple is stretched over the hard plastic tube to feed the contents of the container to the child. Once the bottle is empty, the plastic liner is disposed of and the plastic tube and nipple cleaned for reuse. Though that disposable bottle dispenses with much of the effort associated with sterilization, the user is still required to wash the tube and nipple after each feeding and is also required to separately purchase feeding liquid.

Another disposable bottle consists of a hard plastic or glass base or container containing fully prepared feeding liquid. The bottle includes a screw-off metal lid which when removed allows a female ring and nipple assembly to be attached to the bottle to allow for feeding of the child. Though that disposable bottle alleviates the need for separately purchased liquid, use of such plastic or glass containers results in substantially increased costs. In addition, there is with the glass bottle, the additional risk of breakage which can result in injury to an infant or small child.

The present invention obviates the disadvantages associated with those previous bottles by providing an improved disposable bottle that is convenient to use and which can be easily and economically manufactured. The bottle is preferably constructed of flexible, non-breakable material, e.g., plastic, and thus avoids the danger of injury associated with glass containers.

SUMMARY OF THE INVENTION

The present invention described and disclosed herein comprises an improved disposable baby bottle that is convenient to use and which can be easily and economically manufactured. The bottle is preferably constructed of a flexible, non-breakable material, e.g., plastic, and thus avoids the danger of injury associated with glass containers.

More specifically, the disposable baby bottle of the present invention comprises a substantially cylindrical pouch terminating at an open end and contains a measured amount of feeding liquid. A sealing cover is positioned to overlay the open end of the pouch and is removably secured thereto to prevent contamination of the feeding liquid. A pull tab is integrally formed on the sealing cover to facilitate removal of the sealing cover when it is desired to begin feeding. A substantially rigid annular ring is positioned on the interior surface of the pouch proximate its topmost portion and is molded thereto. The annular ring includes a plurality of spiral threads disposed circumferentially about a portion thereof to receive a conventional ring and nipple assembly and a gripping collar disposed adjacent the spiral threads for facilitating the handling of the disposable bottle. In practice, when it is desired to begin feeding, the sealing cover is removed by pulling up on the pull tab. A conventional ring and nipple assembly is then positioned onto the disposable bottle, making it ready for use.

BRIEF DESCRIPTION OF THE DRAWINGS

A more complete understanding of the invention can be had by reference to the following Detailed Description taken in conjunction with the accompanying Drawings in which:

FIG. 1 is a perspective view of the disposable bottle of the present invention;

FIG. 2 is a sectional view of the disposable bottle of FIG. 1;

FIG. 3 is a top view of the disposable bottle of FIG. 1; and

FIG. 4 is a bottom view of the disposable bottle of FIG. 1.

DETAILED DESCRIPTION OF THE INVENTION

Referring now to the Drawings wherein like reference numerals designate like or corresponding parts throughout, FIG. 1 shows a perspective representation of the disposable bottle of the present invention. The disposable bottle 10 includes a substantially cylindrical pouch 12 terminating in an open end for containing feeding liquid. Pouch 12 is constructed of lightweight, flexible, liquid-impermeable material and is preferably plastic.

A substantially rigid annular ring 16 is positioned on the interior surface of pouch 12 proximate the topmost portion thereof and molded thereto. Annular ring 16 is adapted to receive a ring and nipple assembly 18, as described hereinafter in greater detail with respect to FIG. 2. Annular ring 16 is also preferably constructed of plastic but is substantially rigid as compared to flexible pouch 12. Ring and nipple assembly 18 are of conventional design and are of the type generally known in the industry.

Referring now to FIG. 2, the details of annular ring 16 are shown. As shown in FIG. 2, a plurality of spiral threads 20 are disposed circumferentially about a portion of annular ring 16. Spiral threads 20 cooperate with threads located on ring and nipple assembly 18 to attach assembly 18 onto disposable bottle 10. Annular ring 16 also comprises a gripping collar 22 disposed adjacent spiral threads 20. Gripping collar 22 has a smooth finish and thus provides a gripping surface to facilitate the handling of disposable bottle 10 as the ring and nipple assembly is removed and replaced.

FIG. 3 is a top view of disposable bottle 10. As shown in FIG. 3, a cover 24 is provided and is positioned to overlay the open end of pouch 12 and is removably secured thereto. An outwardly extending tab 26 is integrally formed at one edge of cover 24 and cooperates therewith so that cover 24 can be easily and quickly removed by hand from disposable bottle 10 by simply pulling up on tab 26.

In practice, a measured amount of feeding liquid is introduced into pouch 12 during the assembly process. Thereafter the bottle and its contents are completely sealed and cover 24 is maintained on the pouch until it is desired to begin feeding to safeguard the container contents against contamination and also guard against undetected tampering. When it is desired to begin feeding the child, cover 24 is manually removed by pulling up on tab 26 as described above. A ring and nipple assembly is then screwed onto spiral threads 20 as the user grips collar 22. The disposable bottle is then in condition for feeding. Because pouch 12 is constructed of flexible material, it will collapse slightly as the liquid is nursed from the container, thereby avoiding ingestion of air by the infant which commonly occurs with non-flexible glass or hard plastic bottles.

FIG. 4 is a bottom view of disposable bottle 10. As shown in FIG. 4, the edges 30 of the bottom surface of pouch 12 are preferably crimped so that disposable bottle 10 is self-supporting. The bottle can thus stand upright and need not be physically held by the user. It is also possible to support the bottle appropriately so that the infant can feed from the bottle without requiring that the bottle be manually held in place. The present disposable pre-filled bottle thus avoids the limitation of some previous disposable bottles, which by reason of their extreme limpness, were not self-supporting and thus not self-feeding.

In summary, a disposable pre-filled bottle has been disclosed which is simple in construction and which can be easily and economically manufactured. The bottle is preferably constructed of flexible, nonbreakable plastic material and avoids the danger of injury associated with glass containers. The disposable bottle includes a substantially cylindrical pouch containing a measured amount of feeding liquid. A cover is heat sealed onto the pouch to prevent contamination of the feeding liquid. When it is desired to feed the child, the cover is removed and a conventional ring and nipple assembly is attached onto the bottle for feeding of the child.

Although the preferred embodiment has been described in detail, it should be understood that various changes, substitutions and alterations can be made therein without departing from the spirit and scope of the invention as defined in the appended claims.

What is claimed is:

1. A disposable cartridge feeding bottle for cooperative engagement to a baby bottle nipple and baby bottle retaining ring, said baby bottle retaining ring including an aperture through which said nipple is pushed and maintained and having downwardly depending female threads for engagement to male threads on the outside of said feeding bottle;

said disposable cartridge feeding bottle comprising:

a pouch, constructed from a substantially cylindrical, lightweight, flexible, liquid impermeable plastic, said pouch configured as a frustum having an enlarged, enclosed, lower end and an upper end extending upwardly to and toward a nipple receiving end of said bottle;

a substantially rigid ring member, circumferentially coupled to the inside of said pouch proximate the upper end thereof, said substantially rigid ring member having a frustum shape complementary to the frustum shape of the upper end of said pouch;

said substantially rigid ring member further defining on the exterior surface thereof a plurality of male spiral threads disposed about the circumferential surface thereof and adapted to cooperate with the female threads of said baby bottle retaining ring;

the upper end of said frustum shaped pouch conformed to and over the exterior surface of said frustum shaped substantially rigid ring member and over the exterior surface of said male defined threads and onto and over an inwardly extending annulus defined at the upper end of said threads whereby said lightweight, flexible, liquid impermeable plastic covers said ring member;

a sealing cover disposed to overlay the open of said pouch at said ring member over said annulus whereby said annulus forms a rigid contact surface for adhering said sealing cover over the top of said pouch, said sealing cover including an outwardly extending pull tab integrally formed at one edge of said sealing cover and adapted to cooperate with the sealing cover so that said bottle may be grasped at said ring member and the cover can be removed by pulling upwardly on the tab when it is desired to obtain access to food product contained within said sealed pouch;

said substantially rigid ring member and pouch defining at the portion of said pouch overlying the threads on said ring member the threads for said baby bottle retaining ring whereby said nipple and baby bottle retaining ring can be threaded onto said ring members; and a self-supporting rim comprising a crimped, reinforced circular rim provided at the lower end of said pouch.

* * * * *